US006949736B2

(12) United States Patent
Ishihara

(10) Patent No.: US 6,949,736 B2
(45) Date of Patent: Sep. 27, 2005

(54) METHOD OF MULTI-TURN TIME-OF-FLIGHT MASS ANALYSIS

(75) Inventor: Morio Ishihara, Osaka (JP)

(73) Assignee: JEOL Ltd., Tokyo (JP)

( * ) Notice: Subject to any disclaimer, the term of this patent is extended or adjusted under 35 U.S.C. 154(b) by 0 days.

(21) Appl. No.: 10/934,329

(22) Filed: Sep. 3, 2004

(65) Prior Publication Data

US 2005/0092913 A1 May 5, 2005

(30) Foreign Application Priority Data

Sep. 3, 2003 (JP) ..... 2003-311317

(51) Int. Cl.[7] ..... H01J 49/40
(52) U.S. Cl. ..... 250/282; 280/287
(58) Field of Search ..... 250/282, 287, 250/294, 296, 298

(56) References Cited

U.S. PATENT DOCUMENTS 6,037,586 A * 3/2000 Baril ..... 250/287
6,300,625 B1 10/2001 Ishihara

FOREIGN PATENT DOCUMENTS

| | | |
|---|---|---|
| JP | 11-135060 | 5/1999 |
| JP | 11-135061 | 5/1999 |
| JP | 11-195398 | 7/1999 |

* cited by examiner

*Primary Examiner*—Kiet T. Nguyen
(74) *Attorney, Agent, or Firm*—The Webb Law Firm

(57) ABSTRACT

A method of mass analysis using a multi-turn time-of-flight mass spectrometer starts with recording plural heterogeneous turn number spectra $F_1(t), F_2(t), \ldots, F_q(t)$ containing plural ion peaks that might be different in number of turns, the spectra being obtained with different ion residence times taken from entry to departure using a multi-correlation function for reconstructing a single turn number spectrum.

8 Claims, 6 Drawing Sheets

13.86 μs ION PEAKS OBSERVED AFTER THE GATE WAS OPENED AFTER A LAPSE OF 13.86 μs

| t (μs) | m/z | TURN NUMBER |
|---|---|---|
| 14.75 | 27 | 1.5 |
| 15.39 | 6 | 3.5 |
| 17.26 | 238 | 0.5 |
| 21.06 | 55 | 1.5 |

FIG.6(a)

40.69 μs ION PEAKS OBSERVED AFTER THE GATE WAS OPENED AFTER A LAPSE OF 40.69 μs

| t (μs) | m/z | TURN NUMBER |
|---|---|---|
| 41.58 | 27 | 4.5 |
| 43.81 | 238 | 1.5 |
| 44.89 | 6 | 10.5 |
| 46.58 | 55 | 3.5 |

FIG.6(b)

67.51 μs ION PEAKS OBSERVED AFTER THE GATE WAS OPENED AFTER A LAPSE OF 67.51 μs

| t (μs) | m/z | TURN NUMBER |
|---|---|---|
| 68.41 | 27 | 7.5 |
| 70.19 | 6 | 16.5 |
| 70.36 | 238 | 2.5 |
| 72.11 | 55 | 5.5 |

FIG.6(c)

METHOD OF MULTI-TURN TIME-OF-FLIGHT MASS ANALYSIS

BACKGROUND OF THE INVENTION

1. Field of the Invention

The present invention relates to a method of analyzing mass spectra obtained by a multi-turn time-of-flight mass spectrometer.

2. Description of Related Art

The resolution R of a time-of-flight mass spectrometer is given by $$R = \frac{T}{dT} \tag{1}$$

where dT is the time width of each ion peak and T is the flight time. Accordingly, if the time width dT is constant, the resolution can be increased by increasing the flight time T. To achieve this object, multi-turn time-of-flight mass spectrometers in which increased flight distances are used to improve the resolution R have been proposed in the field of mass spectrometry using time-of-flight mass spectrometers.

A multi-turn time-of-flight mass spectrometer can increase the flight distance of ions while avoiding increase in size of the instrument. Therefore, the small instrument can obtain mass spectra with high mass resolution. To increase the flight time T, it is necessary to increase the flight distance. This, in turn, increases the size of the instrument. Accordingly, it has been contemplated to increase the flight distance by making ions rotate along the same trajectory many times. FIG. 1 shows one example of such an instrument.

Multi-turn time-of-flight mass spectrometers are disclosed in the following publications: Japanese Patent Laid-Open No. H11-135060; Japanese Patent Laid-Open No. H11-135061; and Japanese Patent Laid-Open No. H11-195398.

With this instrument, however, as ions make many revolutions, faster ions overrun slower ions on the circulating trajectory. After this phenomenon, peaks of ions having undergone different numbers of turns are mixed on the obtained flight time spectrum. This spectrum is hereinafter referred to as a heterogeneous turn number spectrum. On the other hand, an ordinary time-of-flight spectrum is referred to as a single turn number spectrum. In a heterogeneous turn number spectrum, the numbers of turns of ions giving peaks are unknown in cases where there are peaks of unknown masses. Therefore, it is difficult to obtain a mass spectrum from a time-of-flight spectrum.

Accordingly, in order that ions make many turns and a single turn number spectrum be obtained, the velocity range of ions to be measured simultaneously may be restricted to prevent overrunning of ions spatially.

In this method, however, the mass range of ions that can be measured simultaneously is restricted. Where ions in a wide range should be measured, it is necessary to splice together many single turn number spectra. Consequently, the sensitivity is substantially deteriorated. This is detrimental to the measuring time.

SUMMARY OF THE INVENTION

In view of the foregoing, it is an object of the present invention to provide a multi-turn time-of-flight mass spectrometer in which the foregoing drawbacks have been alleviated. It is a more specific object of the present invention to provide a method of reconstructing a single turn number spectrum from plural heterogeneous turn number spectra obtained by a multi-turn time-of-flight mass spectrometer.

A method of multi-turn time-of-flight mass analysis for achieving the above-described objects in accordance with the present invention is implemented using a time-of-flight mass spectrometer having a portion for producing ions in a pulsed manner, a multi-turn ion trajectory portion for causing ions to travel in the same circulating trajectory many times, an ejection portion for ejecting the ions out of the ion trajectory portion, and an ion detection portion for detecting the ejected ions. After turning many times in the trajectory portion, the ions are taken out and dispersed according to flight time. Thus, a mass spectrum is obtained. The method of multi-turn time-of-flight mass analysis starts with recording plural heterogeneous turn number spectra $F_1(t)$, $F_2(t)$, . . . , $F_q(t)$ containing plural ion peaks that might be different in number of turns. The spectra are obtained with different ion residence times, i.e., taken from entry to departure. A definable multi-correlation function G(t) is obtained from the heterogeneous turn number spectra. In this way, a single turn number spectrum is reconstructed. The multi-correlation function G(t) is given by $$G(T) = \int_{y_l}^{y_u} H[F_1\{N_1(T)\times T + y\}, F_2\{N_2(T)\times T + y\}, \cdots, F_r\{N_r(T)\times T + y\}]dy$$

where $N_j(T)$ (i=1, 2, . . . , q) is an integer determined by the time T (herein also referred to as one turn time) taken for ions to make one turn in the circulating trajectory, $y_u$ is an upper limit value of the deviation time from one turn time T, $y_i$ is a lower limit value of the deviation time from one turn time T, and H is a function determined by the value of $F_j\{N_j(t)\times T+y\}$ (j =1, 2, . . . , r).

In one feature of the present invention, the range bounded by the limit values $y_u$ and $y_l$ is wider than a range in which ions of one turn time T are forecast to be detected.

In another feature of the present invention, the limit values $y_u$ and $y_l$ are functions of one turn time T.

In a further feature of the present invention, if it is assumed that ions of one turn time T are contained in a heterogeneous turn number spectrum $F_j(t)$, the integer $N_j(T)$ is a forecast number of turns of the ions.

In an additional feature of the present invention, the function H provides a calculation of the arithmetic mean of $F_j\{N_j(t)\times T+y\}$ (j=1, 2, . . . , r).

In still another feature of the present invention, the function H provides a calculation of the minimum value of $F_j\{N_j(t)\times T+y\}$ (j=1, 2, . . . , r).

In yet another feature of the present invention, the function H provides a calculation of the geometric mean of $F_j\{N_j(t)\times T+y\}$ (j=1, 2, . . . , r).

In an additional feature of the present invention, the function H provides a calculation of the harmonic mean of $F_j\{N_j(t)\times T+y\}$ (j=1, 2, . . . , r).

Other objects and features of the present invention will appear in the course of the description thereof, which follows.

BRIEF DESCRIPTION OF THE DRAWINGS

FIGS. 6(*a*) 6(*b*) 6(*c*) shows tables illustrating one embodiment of the present invention;

DESCRIPTION OF THE PREFERRED EMBODIMENTS

Figure 1:
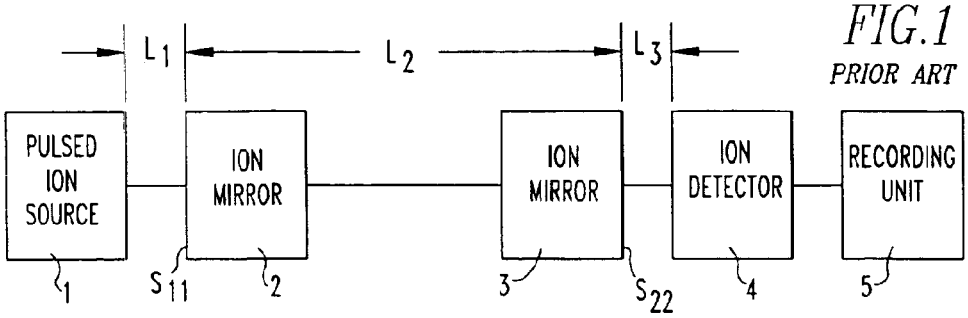
FIG.1 PRIOR ART
FIG. 1 is a diagram showing a conventional multi-turn time-of-flight (TOF) mass spectrometer.

FIG. 1 is a schematic diagram of a time-of-flight (TOF) mass spectrometer to which the present invention can be applied. This instrument has a pulsed ion source 1 for producing ions in a pulsed manner, a first ion mirror 2, and a second ion mirror 3. Furthermore, the instrument includes a multi-turn circulating trajectory portion of ions in which ions are made to travel in the same trajectory many times, an ejection portion for ejecting the ions from the trajectory portion, an ion detector 4 for detecting the ejected ions, and a control-and-recording unit 5 for controlling the timings at which the ions are made to enter and exit and recording the flight times of the detected ions. In the present embodiment, the second ion mirror 3 acts also as the ejection portion.

Figure 8:
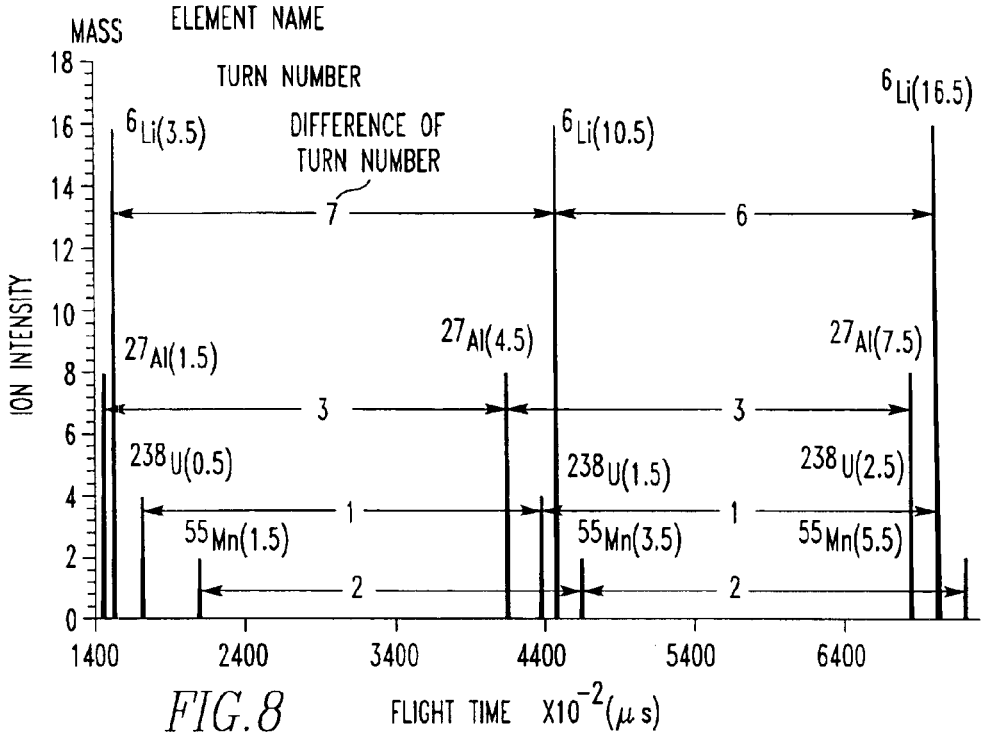
FIG. 8 is a diagram obtained by one embodiment of the present invention.

As can be understood from the description of the present embodiment, "travel in the circulating trajectory" means "circulating travel in a closed trajectory", such as a circular, elliptical, or figure 8-shaped trajectory as shown in the references identified above. In addition, the "travel in the circulating trajectory" means reciprocation along a non-closed trajectory as shown in FIG. 1.

Figure 2:
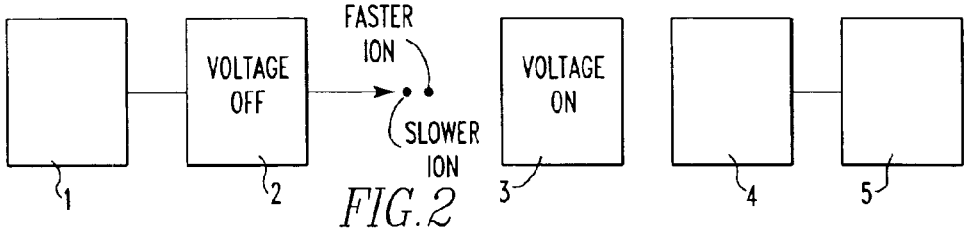
FIG.2 PRIOR ART
FIG. 2 is a diagram illustrating the operation of the conventional multi-turn TOF mass spectrometer.
Figure 3:
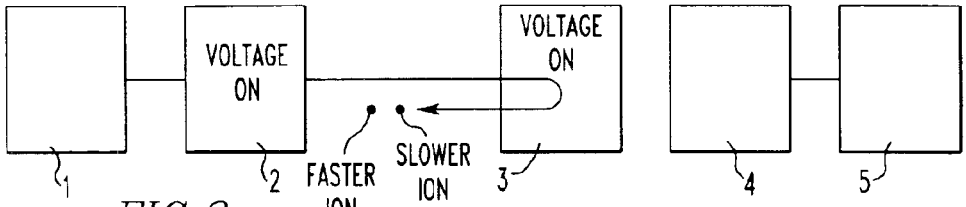
FIG.3 PRIOR ART
FIG. 3 is a diagram illustrating the operation of the conventional multi-turn TOF mass spectrometer.

Ions emitted from the pulsed ion source 1 pass through the first ion mirror 2 and enter the circulating trajectory portion (FIG. 2). At this time, the voltage on the first ion mirror 2 is off and so the ions can pass. The incident ions reach the second ion mirror 3. The voltage on the second ion mirror 3 is on. Therefore, the ions are repelled toward the first ion mirror 2 (FIG. 3). If the voltage on the first ion mirror 2 is turned on before the ions reach the first ion mirror 2, the ions are repelled again toward the second ion mirror 3. In this state, the ions reciprocate between the two ion mirrors along the circulating trajectory. As the number of reciprocations is increased, the flight distance increases. As a result, faster and slower ions become more different in flight distance. After a lapse of an appropriate time, if the voltage on the second ion mirror 3 is turned off, the ions in the circulating trajectory pass through the second ion mirror 3, move straight, and reach the ion detector 4, where the ions are detected in turn from faster ions. The principle of the instrument has been described so far.

It is to be understood that this instrument has been described to illustrate the principle of the present invention. The present invention can be applied to any type of multi-turn TOF mass spectrometer having a circular, elliptical, or figure 8-shaped trajectory as shown in the references identified above.

The flight time of ions is now discussed. Let $L_1$ be the effective distance between the pulsed ion source 1 and the incident surface $S_{11}$ of the first ion mirror 2. Let $L_2$ be the effective distance between the incident surface $S_{11}$ and the exit surface $S_{22}$ of the second ion mirror 3. Let $S_3$ be the effective distance from the exit surface $S_{22}$ to the ion detector 4. Let $L_4$ be the effective flight distance that ions must travel to reciprocate once between the first ion mirror 2 and the second ion mirror 3. The effective distances referred to herein are distances determined in cases where times necessary for acceleration and deceleration are converted into corresponding distances. Therefore, it cannot be said that the effective distances are strictly identical for all ions. However, the effective distances are approximately given by geometrical conditions.

The velocity V of an ion and one turn time T (i.e., period) taken for the ion to make one revolution in the circulating trajectory have the relation $$V = \frac{L_4}{T} \tag{2}$$

The total flight time S of the ion is a function of the number of turns N and the period T and given by $$\begin{aligned} S(N, T) &= \frac{L_1 + L_2 + L_3 + N \times L_4}{V} \\ &= \frac{(L_1 \times L_2 + L_3 + N \times L_4)T}{L_4} \\ &= (D + N)T \end{aligned} \tag{3}$$

where $$D = \frac{L_1 + L_2 + L_3}{L_4} \tag{4}$$

To detect ions normally after they make N turns in the circulating trajectory, the conditions of the times at which the ion mirrors are turned on and off are now discussed. It is assumed that the ions are emitted at time t=0. Let $t_1$ be the time at which the first ion mirror 2 is turned on. Thus, we have $$t_1 < \frac{L_1}{V} + T \tag{5}$$

At this time, the relation $V=L_4/T$ holds and so the following relation must hold:

$$t_1 < \left(\frac{L_1}{L_4}\right)T + T \tag{6}$$

Let $t_2$ be the time at which the second ion mirror 3 is turned off. The following relation must hold:

$$a(N, T) < t_2 < b(N, T) \tag{7}$$

where a (N, T) is the instant of time when the ions have just started the Nth normal trip along the circulating trajectory after leaving the second ion mirror 3, and b (N, T) is the instant of time when the ions are about to enter the second ion mirror 3 after finishing the Nth trip along the circulating trajectory. More specifically, they are given by $$a(N, T) < \frac{(L_1 + L_2 + (N-1) \times L_4 + d_1)T}{L_4} \tag{8}$$

-continued $$b(N, T) < \frac{(L_1 + L_2 + N \times L_4 - d_2)T}{L_4} \tag{9}$$

where $d_1$ is the effective flight distance within the second ion mirror 3 and $d_2$ is the length of the second ion mirror 3, i.e., the flight distance achieved when the ion mirror voltage is off. Since a(N+1, T) and b(N, T) are not equal, there is an insensitive period in which even ions traveling in the circulating trajectory are not detected normally, depending on the value of the time $t_2$.

A case is discussed in which measurement of a heterogeneous turn number spectrum is repeated q times with varying ion residence time (i.e., from entry to departure). The period from the emission from the pulsed ion source 1 to the instant when the second ion mirror 3 is turned off is set to different values $s_1, s_2, \ldots, s_q$ corresponding to the q measurements. The obtained spectra are individually recorded. As a result, q heterogeneous turn number spectra are derived. These spectra are respectively indicated by $F_1(t), F_2(t), \ldots, F_q(t)$.

It is now demonstrated that an ion of velocity V providing the period T is contained in these spectra. The necessary condition that the ion of period T be contained in $F_1(t)$ is that an integer $N_1$ capable of satisfying the following inequality exists:

$$a(N_1, T) < s_1 < b(N_1, T) \tag{10}$$

where $s_1$ is the time at which the second ion mirror 3 is turned off. If this integer $N_1$ is present, it can be identified as a single value. At this time, Eq. (3) indicates that a peak of the ion of the period T is detected near time $h_1$ indicated by $$h_1 = (N_1 + D) \times T \tag{11}$$

from the heterogeneous turn number spectrum $F_1(t)$. The reason why the time is expressed using the expression "near" is that the obtained values of the effective flight distances of $L_1$, $L_2$, and so on are only rough values. Normally, their accurate values are unknown. By applying the same theory to other times $s_j$ (j=1, 2, . . . , q), the possibility that peaks of ions of period T are contained can be determined. Also, the number of turns $N_j$ in a case where a peak is detected can be determined.

Let r be the number of heterogeneous turn number spectra which have been judged that they might contain peaks of ions of the period T. Since a subscript is used at will, if a possible spectrum is given by $F_j$ (j=1, 2, . . . , r), the generality of the following discussion is not lost.

At this time, if there are ions of period T, peaks of the ions of interest should be present close to time $h_j$ given by $$h_j = (N_j + D) \times T \tag{12}$$

Let y be the deviation time from the time $h_j$ at which a peak should appear. This deviation time y should be common to every ion regardless of the integer $N_j$, for the following reason. For the same ion, the period T is the same for all trips in the circulating trajectory. The causes of deviation are setting of the effective times, delay in the pulsed circuit, deviation of the time of ion emission, and so on, which are not related to the number of turns. Accordingly, every ion peak is present in $F_1(h_1+y)$, $F_2(h_2+y)$, . . . , $F_r(h_r+y)$. It is difficult, however, to know the deviation time y in advance. However, if the deviation time is varied in appropriate increments, there is an equality $y=y_0$ at which every $F_j(h_j+y_0)$ has a large value. Conversely, if such $y_0$ is detected, it is demonstrated that ions of period T are present. Note that $y_0$ has a finite spread corresponding to the width of the ion peak. Accordingly, the strength G(T) of an ion of period T is defined in terms of the following multi-correlation function:

$$G(T) = \int_{y_l}^{y_u} H[F_1(h_1 + y), F_2(h_2 + y), F(h_3 + y), \cdots, F_r(h_r + y)]dy \tag{13}$$

where the function H $(F_1, F_2, \ldots, F_r)$ is a function of a variable $F_j$. Various features can be given only depending on the method of determining the function. The expression is in an integral form. Obviously, in actual calculations, the expression may be replaced by a form of discrete summation. The lower limit value $y_a$ and upper limit value $y_b$ of the deviation time from the time $h_j$ at which a peak originating from an ion of period T appears may be determined according to actual situations. That is, setting the range somewhat wider than the range of possible error of $h_j$ is advantageous in terms of the calculation time. In principle, setting the range to a wider range will present no problems. Furthermore, Eq. (13) can be rewritten into the form:

$$G(T) = \int_{y_l}^{y_u} H\{F_1(N_1 \times T + y), F_2(N_2 \times T + y), F_3(N_3 \times T + y), \cdots, F_r(N_r + T + y)\}dy \tag{14}$$

where $$y_u = y_b + D \times T \tag{15}$$

$$y_l = y_a + D \times T \tag{16}$$

A specific form of the function H $(F_1, F_2, \ldots, F_r)$ is now discussed. The simplest definition of the function H is to take the arithmetic mean of $F_j$'s. That is, $$H(F_1, F_2, \cdots, F_r) = \frac{F_1 + F_2 + \cdots + F_r}{r} \tag{17}$$

In this case, each $F_j$ has a large value at $y=y_0$ and so G(T) that is an integrated value of the range $(Y_u \leqq y \leqq y_l)$ containing $y_0$ also has a large value. In this method, however, if $F_j$ happens to have a large value, G(T) is equal to the product of $F_j$ and 1/r, i.e., has a large value. That is, pseudo-peaks will also appear. This complicates the spectrum. Hence, it is highly likely that it is difficult to interpret the spectrum.

To eliminate the pseudo-peaks, the calculation for taking the minimum peak $F_j$ from spectral peaks $F_1, F_2, \ldots, F_r$ may be defined as the function H. In this case, however, the spectral peaks other than $F_j$ are not reflected in the results of calculation. Therefore, there is the disadvantage that other observed data all become useless.

One method of compensating the drawback with the arithmetic averaging method is to take the geometric mean. That is, $$H(F_1, F_2, \cdots, F_r) = \sqrt[r]{F_1 \times F_2 \times \cdots \times F_r} \tag{18}$$

If the number r increases to a considerably large value, the probability that every Fj happens to have a large value decreases considerably. Accordingly, in cases where y is other than $y_0$, at least one value is quite small. In the geometric averaging method, if any one value becomes null, G(T) takes the form of the product of $F_j$'s and becomes equal to zero irrespective of the values of the other $F_j$'s. Consequently, pseudo-peaks due to accidental coincidence are eliminated. As a result, no pseudo-peaks are finally contained in a single turn number spectrum G(T) reconstructed from plural heterogeneous turn number spectra $F_j(t)$.

If the harmonic mean is taken instead of the geometric mean, the same advantages can be expected as the geometric averaging method. That is, $$H(F_1, F_2, \cdots, F_r) = \frac{r}{\frac{1}{F_1} + \frac{1}{F_2} + \cdots + \frac{1}{F_r}} \tag{19}$$

Also, in this case, if any peak having an intensity of 0 is contained in peak intensities $F_j$'s, the harmonic mean found from the peak is 0. Thus, it is judged as a pseudo-peak. Finally, such pseudo-peaks are not contained in a single turn number spectrum G(T) reconstructed from plural heterogeneous turn number spectra $F_j(t)$.

Besides, various definitions of the function H are conceivable. A definition in which small values are reflected to a larger extent in the function H out of various values of $F_j$'s is desirable. Generally, as the number of turns along the trajectory increases, the ion intensity decreases. Therefore, it is advantageous to normalize the $F_j$'s before the multi-correlation function is taken.

The definition of G(T) has been described so far for the case where the period T is determined. The period T of ions traveling in the circulating trajectory differs according to different mass numbers of ions. Therefore, the value of the period T is varied as a final phase. G(T) is found within a required range. Thus, a single turn-number spectrum is obtained. In this way, a single turn-number spectrum can be reconstructed from plural heterogeneous turn number spectra $F_j(t)$.

This single turn-number spectrum G(T) is a spectrum regarding the time taken for ions to make one reciprocation along the circulating trajectory. The other portions, e.g., the contribution of the time corresponding to D×T, are eliminated.

Figure 4:
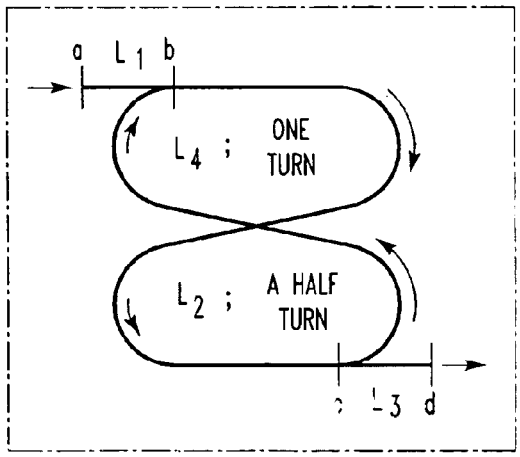
FIG. 4 is a diagram illustrating the principle of one embodiment of the present invention.

The principle of the present invention is described using a specific example of simulation. A figure 8-shaped multi-turn time-of-flight mass spectrometer as shown in FIG. 4 is adopted as an optical system. Ions are ejected from a point a and travel a distance of $L_1$ (=0.1 mm) straightly. Then, the ions are made to enter a circulating trajectory from a point b. A gate that is opened at given timing is mounted at the point b. After the ions leave the point a, the gate is opened immediately before the ions reach the point b. The ion accelerating voltage at the point a is set to 7 kVolts.

When the ions entering the circulating trajectory from the point b make a half revolution along the figure 8-shaped circulating trajectory (over a distance $L_2$ of 1 m), the ions reach the point c where the gate that opens at given timing is mounted. The gate can be opened at arbitrary timing. In this way, ions can be taken out from the circulating trajectory after the ions make a half turn, after 1.5 turns, after 2.5 turns, after 3.5 turns, and after other given number of turns. The flight distance $L_4$ of the ions which go from the point b through the point c and reach the point b again along the figure 8-shaped circulating trajectory (i.e., make one turn) is just twice the distance $L_2$, i.e., 2 m.

The ions taken out of the circulating trajectory from the point c via the gate intact move a distance of $L_3$ (=0.2 m) straightly and are detected by an ion detector placed at a point d.

Four kinds of ions, i.e., lithium ions (m/z=6), aluminum ions (m/z=27), manganese ions (m/z=55), and uranium ions (m/z=238), are assumed as ions traveling in the optical system described above. The timings at which the gate placed at the point c is opened are 13.86 μs, 40.69 μs, and 67.51 μs after the ions leave the point a. At these timings, the aluminum ions reach the point c after making 1.5 turns, 4.5 turns, and 7.5 turns.

When the gate at the point c was opened after a lapse of 13.86 μs since the departure of the ions, the flight times of the ion peaks detected by the ion detector at the point d were four, i.e., 14.75 μs, 15.39 μs, 17.26 μs, and 21.06 μs, respectively.

When the gate at the point c was opened after a lapse of 40.69 μs since emission of ions, the flight times of ion peaks detected by the ion detector at the point d were four, i.e., 41.58 μs, 43.81 μs, 44.89 μs, and 46.53 μs, respectively.

When the gate at the point c was opened after a lapse of 67.51 μs since emission of ions, the flight times of ion peaks detected by the ion detector at the point d were four, i.e., 68.41 μs, 70.19 μs, 70.36 μs, and 72.11 μs, respectively.

Figure 5:
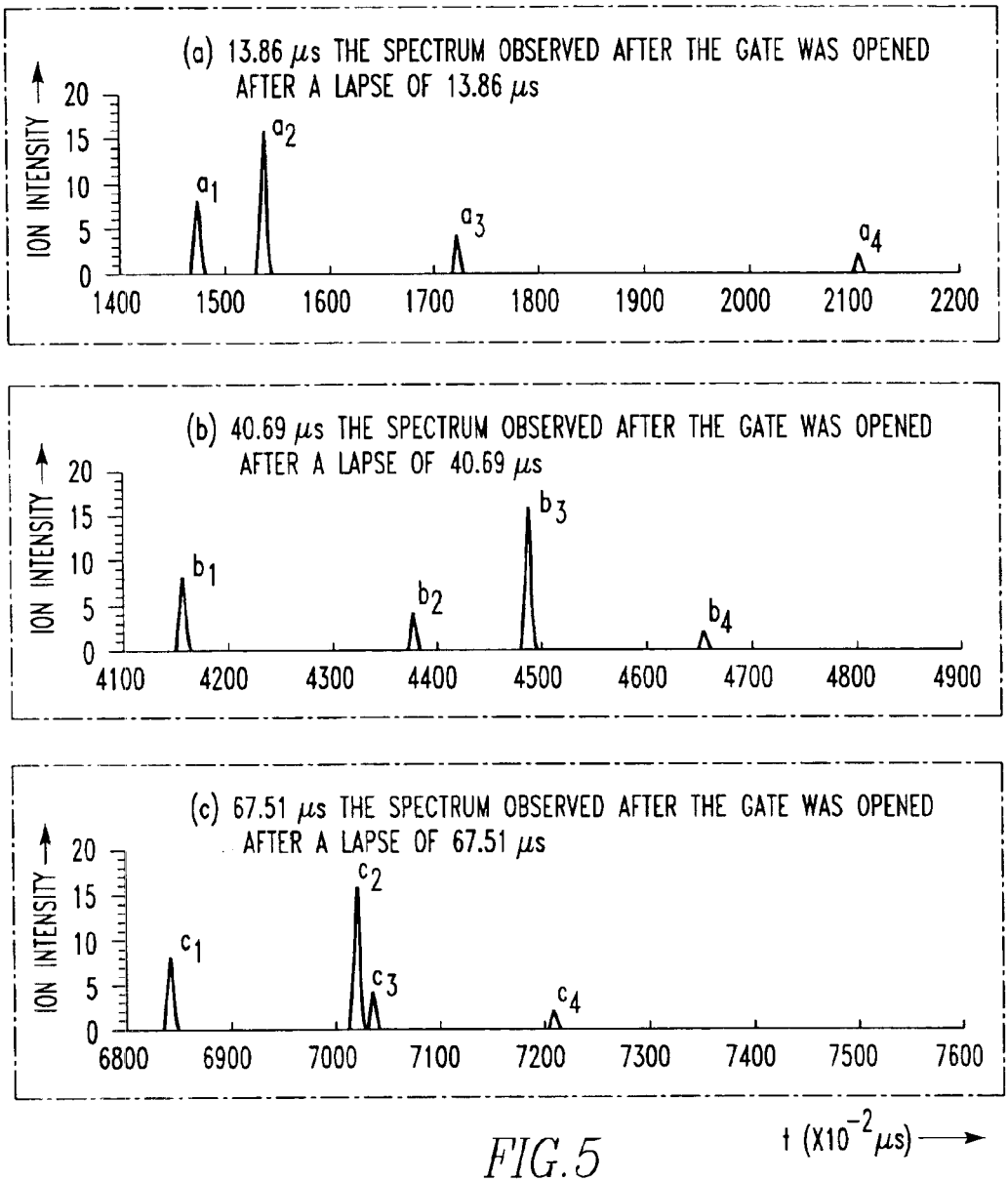
FIG. 5 is a diagram obtained by one embodiment of the present invention.

These are summarized into FIG. 5, which corresponds to $F_j(T)$. It is assumed that the m/z values of ions giving four kinds of peaks are unknown. Ions are accelerated at 7,000 volts while varying the ion mass in mass unit increments. The time (period T) taken for the ions to travel along the circulating trajectory of 2 m was calculated. Three TOF mass spectra (a), (b), and (c) were obtained after lapses of 13.86 μs, 40.69 μs, and 67.51 μs, respectively, since emission of the ions. These mass spectra were searched within a range of a given width of y for ion peaks containing time elements corresponding to N times (N=0.5, 1.5, 2.5, 3.5, and so forth) the calculated time. In this way, the assignments of the peaks could be determined. If a peak containing a time element that is N times as long as the period T is detected within the range of the given width of y, then the presence of ions of period T is proved. This processing is automatically performed by G(T) of the present invention. Since this processing involves a huge amount of calculation, it is desired to use a computer for the calculation.

The results of the calculation reveal that three peaks of 15.39 μs ($a_2$), 44.89 μs ($b_3$), and 70.19 μs ($c_2$) of the mass spectra (a), (b), and (c) obtained after lapses of 13.86 μs, 40.69 μs, and 67.51 μs, respectively, since ejection of ions represent peaks produced when ions of mass 6 made 3.5 turns, 10.5 turns, and 16.5 turns, respectively, and that three peaks of 14.75 μs ($a_1$), 41.58 μs ($b_1$), and 68.41 μs ($c_1$) represent peaks produced when ions of mass 27 made 1.5 turns, 4.5 turns, and 7.5 turns, respectively. Furthermore, three peaks of 21.06 μs ($a_4$), 46.58 μs ($b_4$), and 72.11 μs ($c_4$) represent peaks produced when ions of mass 55 made 1.5 turns, 3.5 turns, and 5.5 turns, respectively. In addition, three peaks of 17.26 Is ($a_3$), 43.81 its ($b_2$), and 70.36 μs ($C_3$) represent peaks produced when ions of mass 238 made 0.5 turn, 1.5 turns, and 2.5 turns, respectively. The results are listed in FIGS. 6(*a*), 6(*b*), and 6(*c*).

Figure 7:
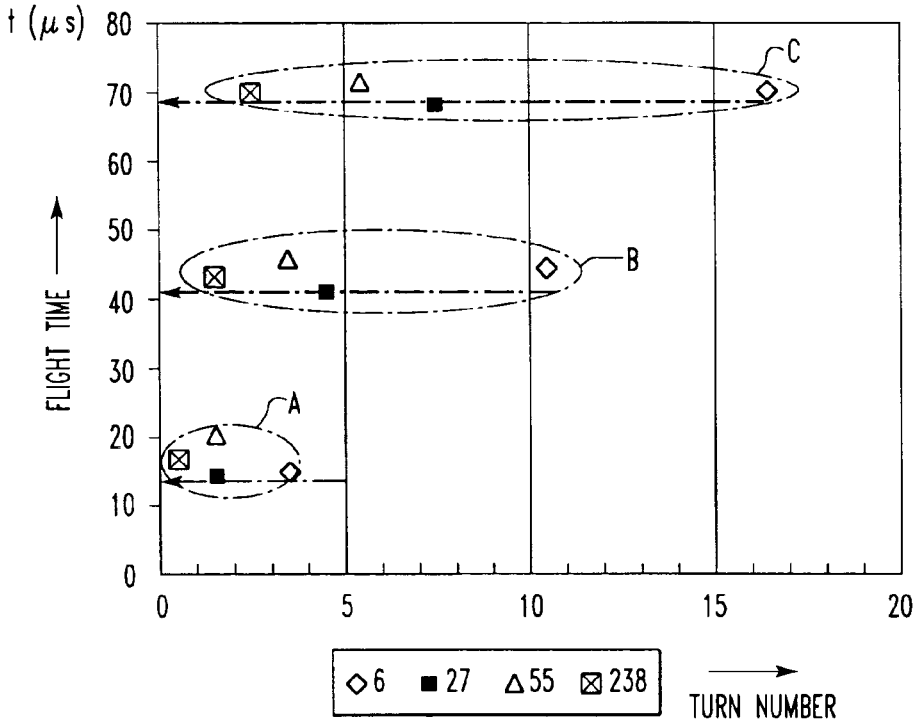
FIG. 7 is a graph illustrating one embodiment of the present invention.

In FIG. 7, the number of turns N is plotted on the horizontal axis and the flight time t (in μs) is on the vertical axis. Four marks surrounded by an ellipse A indicate the peaks of ions taken out from the circulating trajectory after a lapse of 13.86 μs since ejection of the ions. Four marks surrounded by an ellipse B indicate the peaks of ions taken out from the circulating trajectory after a lapse of 40.69 μs since the ejection. Four marks surrounded by an ellipse C indicate the peaks of ions taken out from the circulating trajectory after a lapse of 67.51 μs since the ejection.

Where ions of greatly different masses travel in the same circulating trajectory in this way, lighter ions overrun heavier ions, producing a quite complex mass spectrum. Heterogeneous turn number spectra can be reconstructed into a single turn number spectrum by computationally extracting peaks containing time elements that are N times as large as the period T and normalizing the different turn numbers N.

Figure 9:
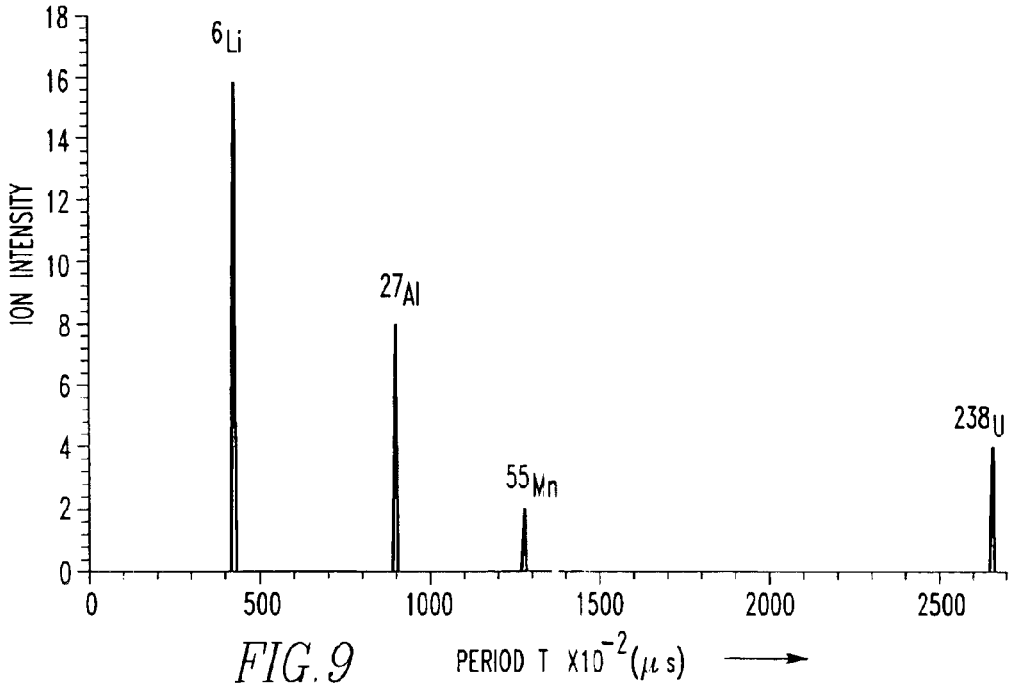
FIG. 9 is a diagram obtained by one embodiment of the present invention.
Figure 10:
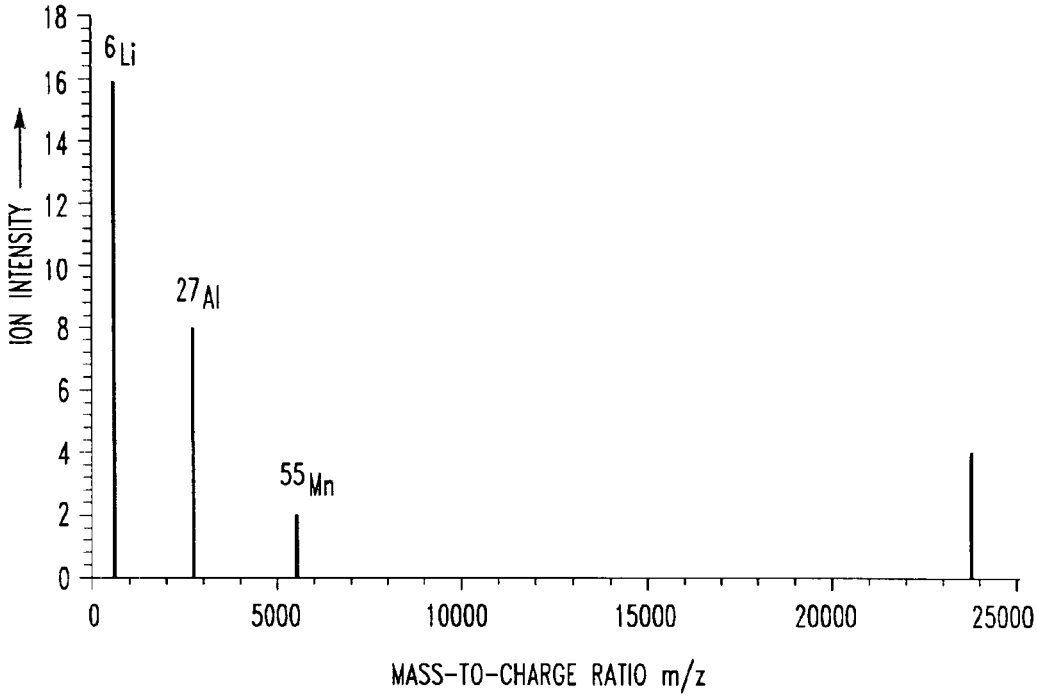
FIG. 10 is a diagram obtained by one embodiment of the present invention.

FIG. 8 is a diagram showing the results of an analysis of a heterogeneous turn number spectrum. Isobaric (same mass) peaks appear with a time difference that is N times as large as the period T. In some cases, however, dropouts may occur. The period is detected with a multi-correlated function G(T). FIG. 9 shows the results of a reconstruction of a heterogeneous turn number spectrum into a single turn-number spectrum. FIG. 10 shows the results of transformation of the horizontal axis T ($\mu$s) of the obtained single turn number spectrum into m/z value.

If peaks due to noise are accidentally introduced into a heterogeneous turn number spectrum, the noise-derived peaks can be eliminated with a quite high probability by taking the geometric mean or harmonic mean of plural peaks obtained from plural heterogeneous turn number spectra. Therefore, noise-derived peaks hardly appear in the finally obtained single turn number spectrum.

The method of analysis of the present invention can be widely used in analysis of heterogeneous turn number spectra obtained by a multi-turn TOF mass spectrometer.

Having thus described my invention with the detail and particularity required by the Patent Laws, what is desired protected by Letters Patent is set forth in the following claims.

The invention claimed is:

1. A method of multi-turn time-of-flight mass analysis implemented using a multi-turn time-of-flight mass spectrometer for measuring and recording flight times, said mass spectrometer having a portion for producing ions in a pulsed manner, a multi-turn ion trajectory portion for causing the ions to travel in the same circulating trajectory many times, an ejection portion for ejecting the ions out of the trajectory portion, and an ion detection portion for detecting the ejected ions, the mass spectrometer being designed to eject the ions after the ions make many turns in the trajectory portion and to disperse the ions according to flight time, thus obtaining a mass spectrum, said method comprising the steps of:

recording plural heterogeneous turn number spectra $F_1(t)$, $F_2(t)$, . . . , $F_q(t)$ containing plural ion peaks that might be different in number of turns, the spectra being obtained with different ion residence times taken from entry to departure; and finding a definable multi-correlation function G(t) from the heterogeneous turn number spectra, whereby reconstructing a single turn number spectrum;

wherein said function G(t) is given by $$G(T) = \int_{y_l}^{y_u} H[F_1\{N_1(T)\times T + y\},\ F_2\{N_2(T)\times T + y\}, \cdots, F_r\{N_r(T)\times T + y\}]dy$$

where $N_j(T)$(j=1, 2, . . . , q) is an integer determined by the time T taken for ions to make one turn in the circulating trajectory, $y_u$ is an upper limit value of a deviation time from one turn time T, $y_l$, is a lower limit value of the deviation time from one turn time T, and H is a function determined by the value of $F_j\{N_j(t)\times T+y\}$ (j=1, 2, . . . , r).

2. A method of multi-turn time-of-flight mass analysis implemented using a multi-turn time-of-flight mass spectrometer for measuring and recording flight times, said mass spectrometer having a portion for producing ions in a pulsed manner, a multi-turn ion trajectory portion for causing the ions to travel in the same circulating trajectory many times, an ejection portion for ejecting the ions out of the trajectory portion, and an ion detection portion for detecting the ejected ions, the mass spectrometer being designed to eject the ions after the ions make many turns in the trajectory portion and to disperse the ions according to flight time, thus obtaining a mass spectrum; said method comprising the steps of:

recording plural heterogeneous turn number spectra $F_1(t)$, $F_2(t)$, . . . , $F_q(t)$ containing plural ion peaks that might be different in number of turns, the spectra being obtained with different ion residence times taken from entry to departure; and finding a definable multi-correlation function G(t) from the heterogeneous turn number spectra, whereby reconstructing a single turn number spectrum;

wherein said function G(t) is given by $$G(T) = \int_{y_l}^{y_u} H[F_1\{N_1(T)\times T + y\},\ F_2\{N_2(T)\times T + y\}, \cdots, F_r\{N_r(T)\times T + y\}]dy$$

where $N_j(T)$ (j=1, 2, . . . , q) is an integer determined by the time T taken for ions to make one turn in the circulating trajectory, $y_u$ is an upper limit value of a deviation time from one turn time T, $y_l$ is a lower limit value of the deviation time from one turn time T, and H is a function determined by the value of $F_j\{N_j(t)\times T+y\}$ (j=1, 2, . . . , r), and wherein a range bounded by the limit values $y_u$ and $y_l$ is wider than a range in which ions of one turn time T are forecast to be detected.

3. A method of multi-turn time-of-flight mass analysis implemented using a multi-turn time-of-flight mass spectrometer for measuring and recording flight times, said mass spectrometer having a portion for producing ions in a pulsed manner, a multi-turn ion trajectory portion for causing the ions to travel in the same circulating trajectory many times, an ejection portion for ejecting the ions out of the trajectory portion, and an ion detection portion for detecting the ejected ions, the mass spectrometer being designed to eject the ions after the ions make many turns in the trajectory portion and to disperse the ions according to flight time, thus obtaining a mass spectrum; said method comprising the steps of:

recording plural heterogeneous turn number spectra $F_1(t)$, $F_2(t)$, . . . , $F_q(t)$ containing plural ion peaks that might be different in number of turns, the spectra being obtained with different ion residence times taken from entry to departure; and finding a definable multi-correlation function G(t) from the heterogeneous turn number spectra, whereby reconstructing a single turn number spectrum;

wherein said function G(t) is given by $$G(T) = \int_{y_l}^{y_u} H[F_1\{N_1(T)\times T + y\},\ F_2\{N_2(T)\times T + y\}, \cdots, F_r\{N_r(T)\times T + y\}]dy$$

where $N_j(T)$ (j=1, 2, . . . , q) is an integer determined by the time T taken for ions to make one turn in the circulating trajectory, $y_u$ is an upper limit value of a deviation time from one turn time T, $y_l$ is a lower limit value of the deviation time from one turn time T, and H is a function determined by the value of $F_j\{N_j(t)\times T+y\}$ (j=1, 2, . . . , r), and wherein the limit values $y_u$ and $y_l$ are functions of one turn time T.

4. A method of multi-turn time-of-flight mass analysis as set forth in any one of claims 1 to 3, wherein if it is assumed that ions of one turn time T are contained in a heterogeneous turn number spectrum $F_j(t)$, said integer $N_j(T)$ is a forecast number of turns of the ions.

5. A method of multi-turn time-of-flight mass analysis as set forth in any one of claims 1 to 3, wherein said function H provides a calculation for taking the arithmetic mean of $F_j\{N_j(t)\times T+y\}$ (j=1, 2, . . . , r).

6. A method of multi-turn time-of-flight mass analysis as set forth in any one of claims 1 to 3, wherein said function H provides a calculation for taking a minimum value of $F_j\{N_j(t)\times T+y\}$ (j=1, 2, . . . , r).

7. A method of multi-turn time-of-flight mass analysis as set forth in any one of claims 1 to 3, wherein said function H provides a calculation for taking the geometric mean of $F_j\{N_j(t)\times T+y\}$ (j=1, 2, . . . , r).

8. A method of multi-turn time-of-flight mass analysis as set forth in any one of claims 1 to 3, wherein said function H provides a calculation for taking the harmonic mean of $F_j\{N_j(t)\times T+y\}$ (j=1, 2, . . . , r).

* * * * *